US009115600B2

(12) United States Patent
Wiebe

(10) Patent No.: US 9,115,600 B2
(45) Date of Patent: Aug. 25, 2015

(54) INSULATED WALL SECTION

(75) Inventor: David J. Wiebe, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 994 days.

(21) Appl. No.: 13/221,156

(22) Filed: Aug. 30, 2011

(65) Prior Publication Data

US 2013/0051995 A1 Feb. 28, 2013

(51) Int. Cl.
*F01D 25/26* (2006.01)
*F01D 25/24* (2006.01)

(52) U.S. Cl.
CPC ..... *F01D 25/26* (2013.01); *F01D 25/24* (2013.01)

(58) Field of Classification Search
CPC ..... F01D 25/14; F01D 25/26; F01D 25/24; F01D 25/265; F01D 25/243
USPC ..... 415/108, 177, 220, 213.1, 214.1
See application file for complete search history.

(56) References Cited

U.S. PATENT DOCUMENTS 4,101,242 A * 7/1978 Coplin et al. ..... 415/134
4,762,462 A * 8/1988 Lardellier ..... 415/177
5,027,604 A 7/1991 Krueger
5,174,714 A 12/1992 Plemmons et al.
5,188,506 A * 2/1993 Creevy et al. ..... 415/115
5,195,868 A 3/1993 Plemmons et al.
5,238,365 A * 8/1993 Petsche ..... 415/178
5,687,572 A 11/1997 Schrantz et al.
6,390,771 B1 * 5/2002 Gervais et al. ..... 415/139
6,422,807 B1 7/2002 Leach et al.
7,793,503 B2 9/2010 Grote et al.
2005/0254945 A1 * 11/2005 VanDuyn ..... 415/229
2006/0153683 A1 * 7/2006 Dube et al. ..... 416/220 R
2009/0246002 A1 * 10/2009 Wakeman et al. ..... 415/142

* cited by examiner

*Primary Examiner* — Edward Look
*Assistant Examiner* — Maxime Adjagbe

(57) ABSTRACT

A turbine section of a turbine engine includes rotatable structure, an outer casing disposed about the rotatable structure, and an inner casing disposed about the rotatable structure and suspended radially inwardly from the outer casing. Rotation of the rotatable structure during operation drives at least one of a compressor and a generator. The inner casing defines a hot gas flow path through which hot combustion gases pass during operation. The inner casing comprises a plurality of wall sections. Each wall section includes a panel having an inner portion and an outer portion opposed from and affixed to the inner portion. The inner portion at least partially defines the hot gas flow path and the inner portion is radially spaced from the outer portion such that a substantially fluid tight chamber is formed therebetween. The fluid tight chamber reduces thermal energy transfer from the inner portion to the outer portion.

20 Claims, 4 Drawing Sheets

INSULATED WALL SECTION

FIELD OF THE INVENTION

The present invention relates to an insulated wall section, such as a wall section forming part of an inner casing in a turbine section of an aeroderivative industrial gas turbine engine.

BACKGROUND OF THE INVENTION

In a turbomachine, such as an aeroderivative industrial gas turbine engine, air is pressurized in a compressor section then mixed with fuel and burned in a combustion section to generate hot combustion gases. The hot combustion gases are expanded within a turbine section where energy is extracted to power the compressor section and to provide output power.

Since many components with the turbine section are directly exposed to the hot combustion gases passing therethrough, these components are typically cooled and/or insulated to prevent overheating thereof.

SUMMARY OF THE INVENTION

In accordance with a first aspect of the present invention, a turbine section of a turbine engine is provided. The turbine section comprises rotatable structure, an outer casing disposed about the rotatable structure, and an inner casing disposed about the rotatable structure and suspended radially inwardly from the outer casing. Rotation of the rotatable structure during operation of the turbine engine drives at least one of a compressor and a generator. The inner casing defines a hot gas flow path through which hot combustion gases pass during operation of the turbine engine. The inner casing comprises a plurality of wall sections. Each wall section comprises a panel having an inner portion and an outer portion opposed from and affixed to the inner portion. The inner portion at least partially defines the hot gas flow path and the inner portion is radially spaced from the outer portion such that a substantially fluid tight chamber is formed therebetween. The fluid tight chamber reduces thermal energy transfer from the inner portion to the outer portion.

The turbine section may further comprise an insulating material in the chamber, the insulating material further reducing an amount of thermal energy transferred to the outer portion of the panel from the inner portion.

The inner casing may comprise a plurality of circumferentially extending rows of the wall sections, each row comprising a plurality of the wall sections.

The turbine section may further comprise a shaft cover assembly disposed about the rotatable structure and located radially inwardly from the inner casing.

The turbine section may further comprise a plurality of struts extending from the outer casing to the shaft cover assembly, the struts providing structural support for the shaft cover assembly.

At least some of the panels may be shaped to define openings so as to allow the struts to extend from the outer casing to the shaft cover assembly.

The struts may be substantially aligned with one another in a circumferential direction.

The inner casing may be suspended from the outer casing via hook structures that are substantially aligned with the struts in the circumferential direction.

The inner casing may be suspended from the outer casing via hook structures that permit relative movement between the inner casing and the outer casing.

The hook structures may comprise first hook shaped members that extend radially inwardly from the outer casing and second hook shaped members that extend radially outwardly from the panels of the inner casing and engage the first hook shaped members so as to secure the inner casing to the outer casing while permitting relative movement therebetween.

The turbine may further comprise a first turbine and a second turbine located axially downstream from the first turbine, wherein the inner casing extends axially between the first turbine and the second turbine.

The rotatable structure may comprise at least one of a first rotatable shaft associated with the first turbine and a second rotatable shaft associated with the second turbine, wherein rotation of the first rotatable shaft drives a compressor and rotation of the second rotatable shaft drives an electric generator.

In accordance with a second aspect of the present invention, a wall section of an inner casing through which hot combustion gases pass in a turbine engine is provided, wherein the inner casing is suspended radially inwardly from an outer casing. The wall section comprises a panel and an insulating material. The panel has an inner portion and an outer portion affixed to the inner portion. The inner and outer portions are radially spaced from and opposed from one another such that a substantially fluid tight chamber is defined therebetween. The inner portion at least partially defines a hot gas path through which the hot combustion gases pass and the outer portion is radially spaced from the hot gas path. The insulating material is disposed in the chamber and limits an amount of heat transferred to the outer portion of the panel from the inner portion.

The insulating material may be completely encapsulated in the chamber.

The insulating material may comprise a porous insulating material.

The insulating material may comprise one of a woven cloth and a ceramic insert having a shape that generally corresponds to the chamber.

The inner and outer portions may each be formed at least partially from at least one of stainless steel, a cobalt alloy, and a nickel alloy.

The outer portion may have a thickness that is less than a thickness of the inner portion.

The panel may include at least one cut-out portion to allow at least one strut to extend from the outer casing to a shaft cover assembly located radially inwardly from the inner casing.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
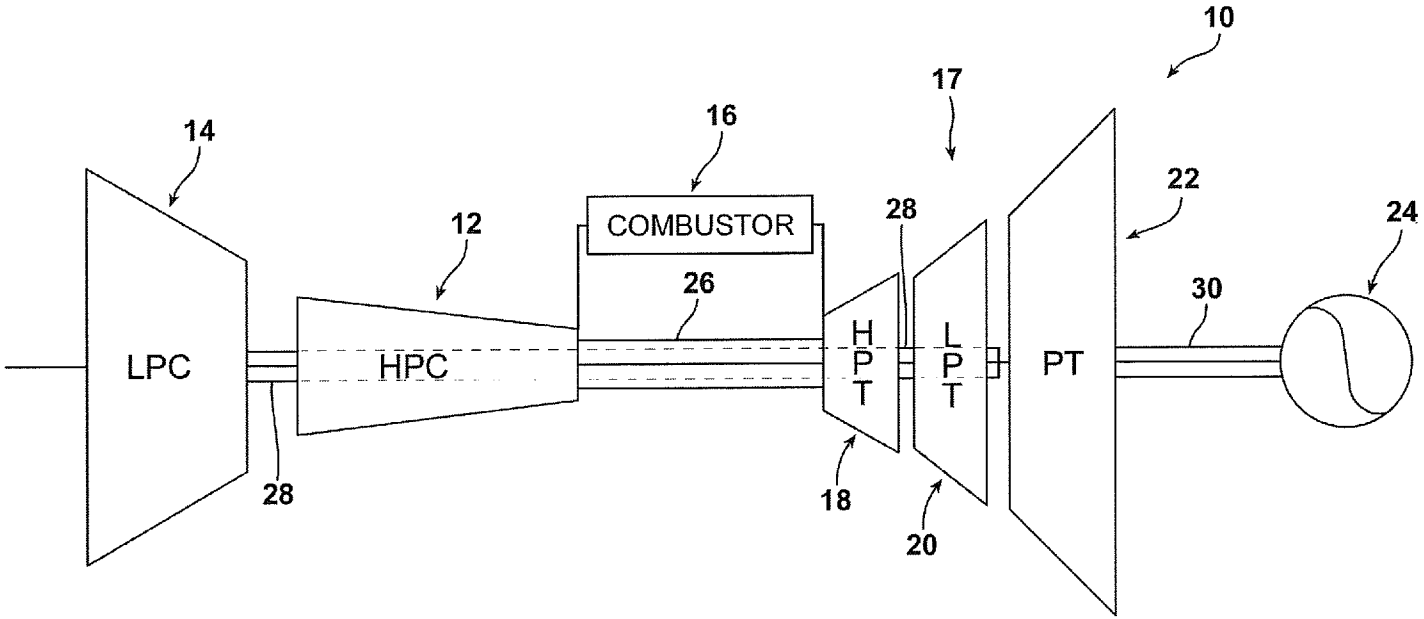
FIG. 1 is a schematic illustration of an aeroderivative industrial gas turbine engine according to an embodiment of the invention.

FIG. 1 schematically illustrates an aeroderivative industrial gas turbine engine 10 comprising a high pressure compressor 12, a low pressure compressor 14, a combustor 16, a turbine section 17 including a high pressure turbine 18, a low pressure turbine 20, and a power turbine 22, and an electric generator 24. The high pressure compressor 12 compresses ambient air to generate high pressure air, e.g., compressed air having a pressure of from about 4 atm to about 20 atm, and the low pressure compressor 14 compresses ambient air to generate low pressure air, e.g., compressed air having a pressure of from about 1 atm to about 4 atm. The high and low pressure compressors 12, 14 are collectively referred to herein as "compressor apparatus".

The combustor 16 combines a portion of the compressed air from the compressor apparatus with a fuel and ignites the mixture creating combustion products defining hot working gases. The working gases travel from the combustor 16 to the turbine section 17. Within each turbine 18, 20 and 22 in the turbine section 17 are rows of stationary vanes (not shown) and rotating blades (not shown). For each row of blades, a separate disc (not shown) is provided. The discs forming part of the high pressure turbine 18 are coupled to a first rotatable shaft 26 (see FIG. 1), which is coupled to the high pressure compressor 12 to drive the high pressure compressor 12. The discs forming part of the low pressure turbine 20 are coupled to a second rotatable shaft 28 (schematically shown in FIGS. 1 and 2), which is coupled to the low pressure compressor 14 to drive the low pressure compressor 14. The second rotatable shaft 28 is positioned within and is co-axial with the first rotatable shaft 26, as depicted in FIG. 1. The discs forming part of the power turbine 22 are coupled to a third rotatable shaft 30 (see FIG. 1), which is coupled to the electric generator 24 to drive the electric generator 24. As the working gases expand through the turbines 18, 20, 22, the working gases cause the rows of rotatable blades within the turbines 18, 20, 22, and therefore the corresponding discs and first, second, and third shafts 26, 28, 30 to rotate.

Figure 2:
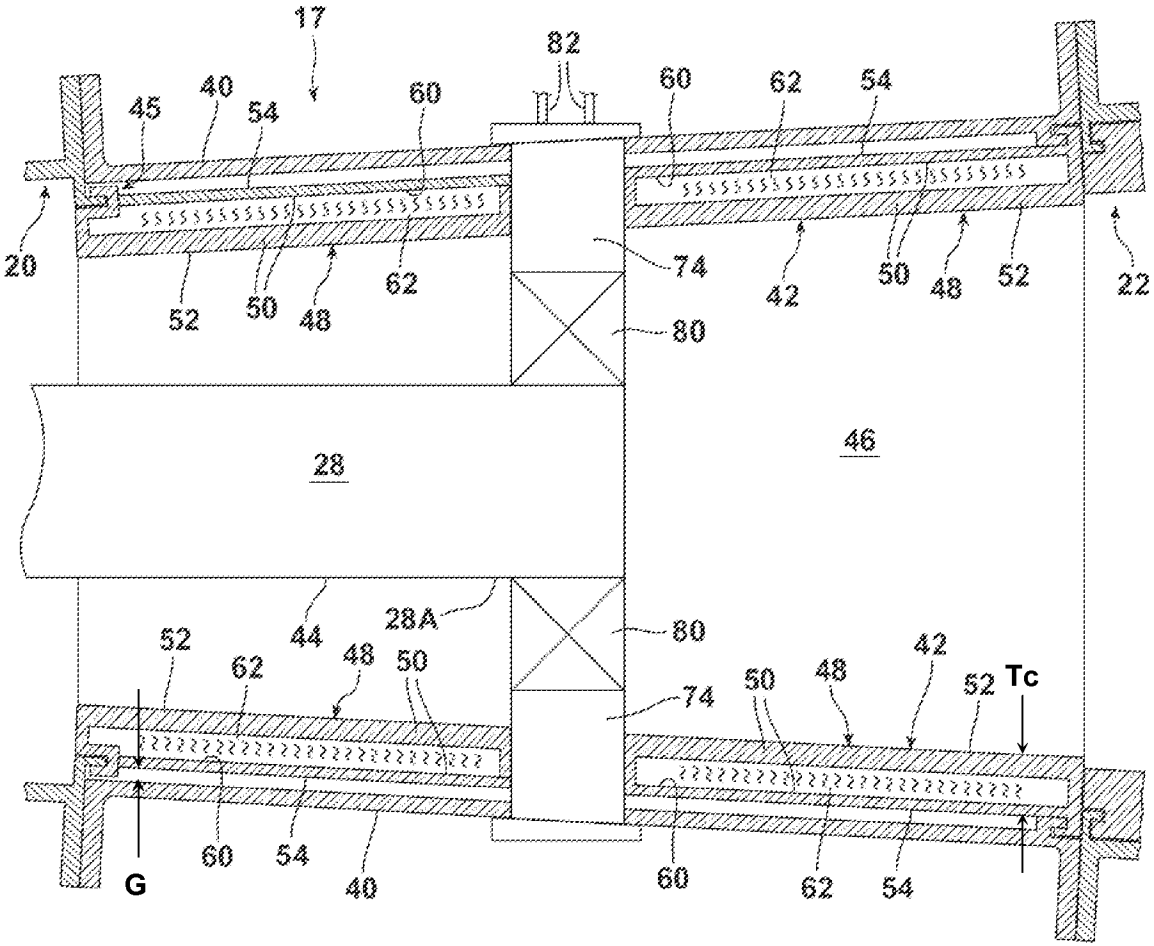
FIG. 2 is a side cross sectional view of a portion of a turbine section of the engine illustrated in FIG. 1 and showing an inner casing through which hot combustion gases pass according to an embodiment of the invention.

FIG. 2 illustrates a portion of the turbine section 17 located between the low pressure turbine 20 and the power turbine 22. This portion of the turbine section 17 includes an outer casing 40, an inner casing 42, and rotatable structure 44. In the embodiment shown, the rotatable structure 44 comprises an aft end portion 28A of the second shaft 28, although it is noted that the rotatable structure 44 could also or alternatively comprise a portion of the third shaft 30, depending on the particular configuration of the engine 10. That is a forward portion (not shown) of the third shaft 30 could extend into and be supported within this portion of the turbine section 17 in addition to or instead of the aft end portion 28A of the second shaft 28. It is noted that the terms "inner", "outer", "radial", "axial", "circumferential", and the like, as used herein, are not intended to be limiting with regard to orientation of the elements recited for the present invention.

The outer casing 40 comprises a generally cylindrical structure and may form part of the main engine casing of the engine 10, as will be apparent to those skilled in the art. As illustrated in FIG. 2, the outer casing 40 is disposed about the rotatable structure 44, i.e., the outer casing 40 is located radially outwardly from the rotatable structure 44.

Figure 3:
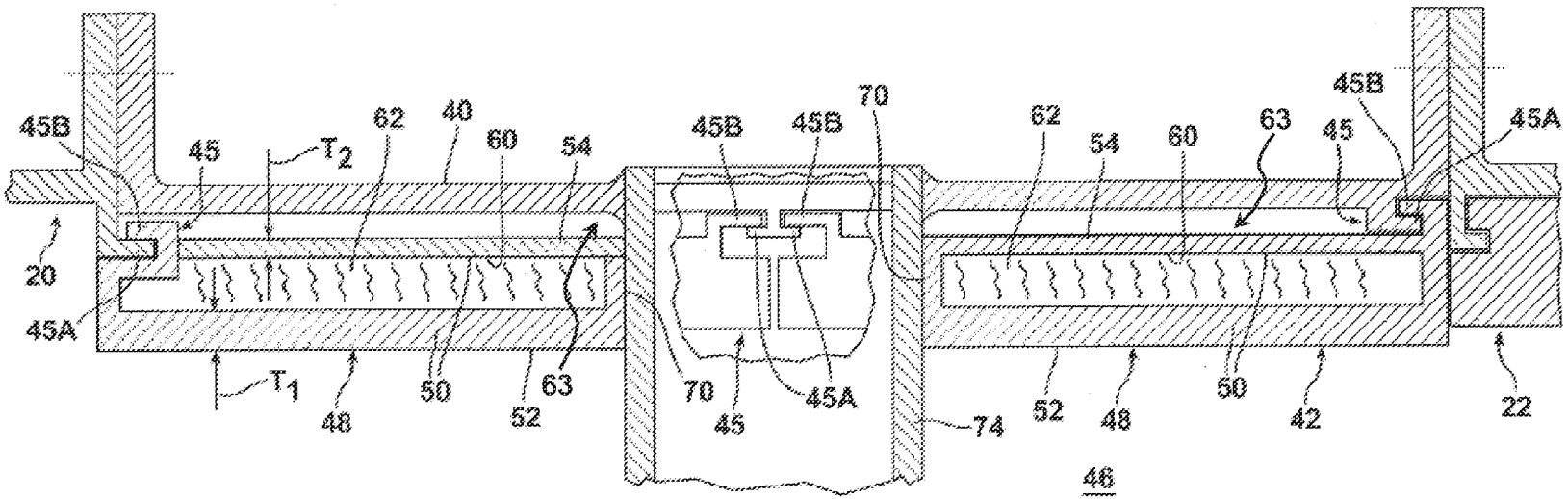
FIG. 3 is an enlarged cross sectional view of a pair of wall sections of the inner casing shown in FIG. 2 and showing the wall sections being suspended from an outer casing.

The inner casing 42 comprises a generally cylindrical structure and is disposed about the rotatable structure 44 radially inwardly from the outer casing 40 such that dead air spaces 63 located between the inner casing 42 and the outer casing 40 are completely encapsulated therebetween, as clearly shown in FIG. 3. The inner casing 42 is suspended radially inwardly from the outer casing 40 via hook structures 45 (see FIG. 3), which hook structures 45 will be described in detail herein. The inner casing 42 defines a hot gas flow path 46 for hot working gases that flow through this portion of the turbine section 17.

The inner casing 42 comprises a plurality of wall sections 48, each wall section 48 comprising a panel 50. The panel 50 of each wall section 48 is formed from a high heat tolerant material, for example, stainless steel, a cobalt alloy, and/or a nickel alloy. In a preferred embodiment, the inner casing 42 comprises two circumferentially extending rows of wall sections 48, as shown in FIG. 2. The number of wall sections 48 included in each circumferentially extending row may vary, but preferably each row comprises between about 6 and about 12 wall sections. Referring still to FIG. 2, each panel 50 has a total thickness Tc, providing the inner casing 42 with the same total thickness $T_C$. The total thickness $T_C$ of the panel/inner casing 50/42 is greater than the largest radial dimension of a gap G formed between the outer casing 40 and the inner casing 42, wherein the gap G defines a radial distance between the outer casing 40 and the inner casing 42.

As most clearly shown in FIG. 3, each panel 50 comprises a radially inner portion 52 and a radially outer portion 54. In the embodiment shown, the inner portion 52 and the outer portion 54 of each panel 50 are opposed and substantially parallel to each other. The inner portion 52 of the each panel 50 may be referred to as the "hot" portion of the panel 50, as the inner portions 52 of the panels 50 define the hot gas flow path 46 and are exposed to the hot working gases during operation. The outer portion 54 of each panel 50 may be referred to as the "cool" portion of the panel 50, as the outer portions 54 of the panels 50 are radially removed from and insulated from the hot gas flow path 46, as will be described in detail herein. Since the inner portions 52 of the panels 50 are directly exposed to the hot working gases during operation of the engine 10, a thickness $T_1$ of the inner portions 52 in the preferred embodiment is greater than a thickness $T_2$ of the outer portions 54, see FIG. 3. For example, the thickness $T_1$ of the inner portions 52 may be about 0.125", while the thickness $T_2$ of the outer portions 54 may be about 0.0625". It is noted that the working gases in this portion of the turbine section 17, i.e., between the low pressure turbine 20 and the power turbine 22, may have temperatures of about 1,100° F. during operation of the engine.

In one embodiment, the inner and outer portions 52, 54 of each panel 50 are integrally formed as a unit. In another embodiment (as shown in FIGS. 2 and 3), the inner portion 52 of each panel 50 is separately formed from and is affixed to the outer portion 54 via any suitable affixation process, for example, by welding. In either case, the inner and outer portions 52, 54 are configured such that a substantially fluid tight chamber 60 is formed radially inwardly from the dead air space 63 between the inner and outer portions 52, 54 of each panel 50. The substantially fluid tight chambers 60 and the dead air spaces 63 provide insulation between the inner and outer portions 52, 54 of each panel 50 so as to reduce thermal energy transfer from the inner portions 52 to the outer portions 54.

In the embodiment shown in FIGS. 2 and 3, an insulating material 62 is disposed in the chamber 60 of each panel 50. While the insulating material 62 is not a necessary component of the invention, i.e., air within the substantially fluid tight chambers 60 between the inner and outer portions 52, 54 would provide insulation for the outer portions 54, the insulating material 62 further reduces an amount of thermal energy transfer from the inner portions 52 to the outer portions 54 of the panels 50. In the preferred embodiment, the insulating material 62 of each panel 50 is completely encapsulated in the corresponding chamber 60 so as to maximize the reduction of heat transfer effected by the insulating material 62. The insulating material 62 may comprise a porous insulating material 62, for example, a woven cloth or a ceramic insert having a shape that generally corresponds to the corresponding chamber 60.

Figure 4:
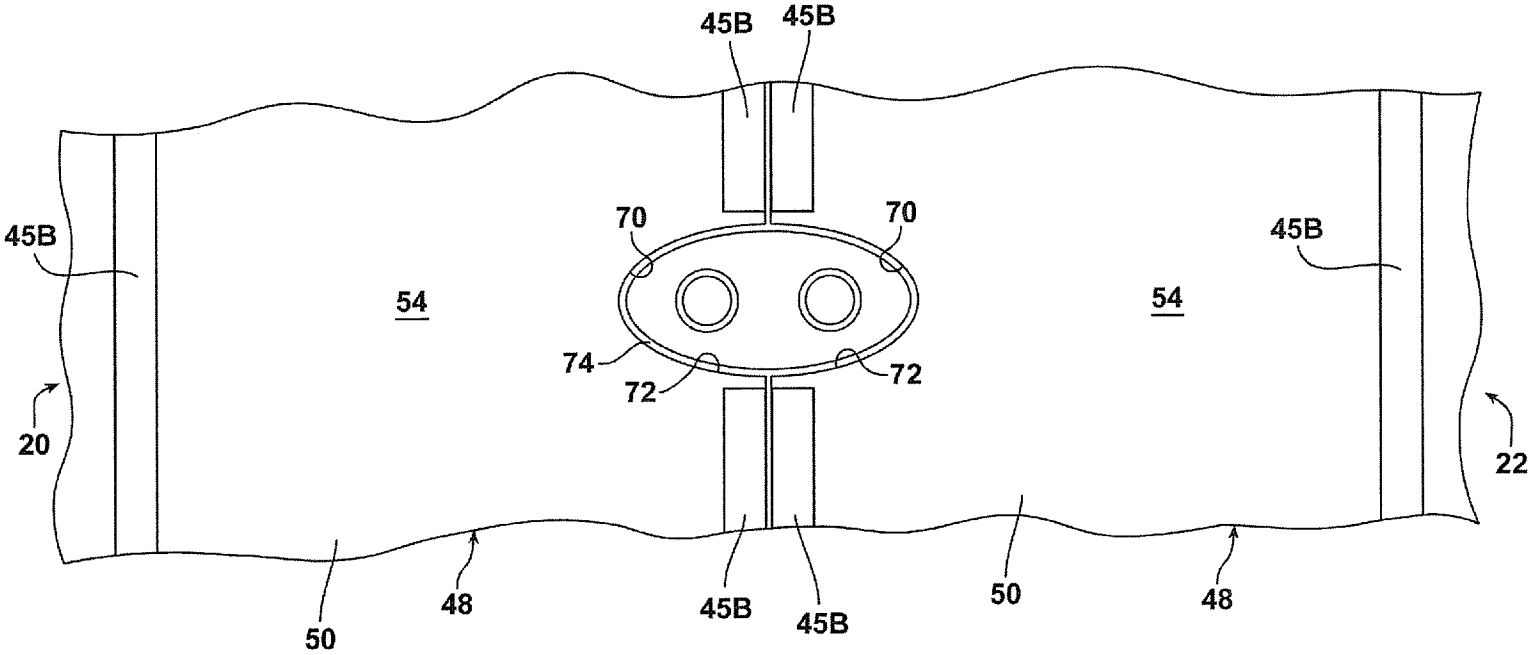
FIG. 4 is a top plan view of the pair of wall sections illustrated in FIG. 3.

Referring to FIG. 4, at least some of the panels 50 include a cut out portion 70. The cut out portions 70 affect the resulting shape of the inner and outer portions 52, 54 and the chamber 60 and insulating material 62 of the corresponding panel 50. However, the chambers 60 of any panels 50 that include one or more cut out portions 70 are still configured so as to be substantially fluid tight.

The cut out portions 70 of adjacent panels 50 are shaped to define an opening 72 so as to allow a strut 74 to extend therethrough. It is noted that more than one cut out portion 70 may be provided in a particular panel 50 if more than one strut 74 is to extend through an opening 72 formed by the panel 50 and an adjacent panel 50.

As shown in FIG. 2, the struts 74 extend from the outer casing 40 through the inner casing 42 to a shaft cover assembly 80 associated with the rotatable structure 44 and located radially between the rotatable structure 44 and the inner casing 42. The shaft cover assembly 80 in the embodiment shown comprises a bearing that is structurally supported by the struts 74 and, in turn, the bearing provides structural support for the rotatable structure 44, i.e., the bearing provides structural support for the aft end 28A of the second shaft 28 in the embodiment shown. In addition to providing structural support for the shaft cover assembly 80, one or more of the struts 74 may provide other functions. For example, the top strut 74 illustrated in FIG. 2 comprises an oil supply strut 74 (the oil supply strut 74 is also illustrated in FIG. 4). As shown in FIGS. 2 and 4, two oil supply tubes 82 extend through the strut 74 for providing oil to the bearing. Other multi-functional struts 74 may include, for example oil draining struts 74, typically located at the bottom of the engine 10, and breather struts 74, as will be apparent to those skilled in the art.

Referring to FIG. 2, the struts 74 are preferably substantially aligned with one another in a circumferential direction. In a typical engine 10, five or more struts 74 may be provided, although any suitable number of struts 74 could be provided.

As noted above, the inner casing 42 is suspended radially inwardly from the outer casing 40 via hook structures 45. Referring to FIG. 3, the hook structures 45 comprise first hook shaped members 45A that extend radially inwardly from the outer casing 40, and second hook shaped members 45B that extend radially outwardly from the panels 50 of the inner casing 42. The second hook shaped members 45B engage the first hook shaped members 45A so as to secure the inner casing 42 to said outer casing 40 while permitting relative movement therebetween. That is, the inner casing 42 is permitted to move radially, axially, and/or circumferentially from the outer casing 40 as a result of the configuration of the hook structures 45. In the preferred embodiment, the hook structures 45 are substantially aligned with the struts 74 in the circumferential direction, as shown in FIG. 3.

In operation, the hot working gases flow through the turbine section 17, as discussed above. While in the portion of the turbine section 17 illustrated in FIG. 2, i.e., between the low pressure turbine 20 and the power turbine 22, thermal energy is transferred from the hot combustion gases to the inner portion 52 of the panels 50. As a result of the chambers 60 in the panels 50, thermal energy transfer from the inner portions 52 of the panels 50 to the outer portions 54 are reduced. This advantage is even further realized if the chambers 50 include the insulating material 62 discussed above.

Further, it is noted that the inner casing 42 tends to incur a larger amount of thermal expansion than does the outer casing 40 during operation, since the inner casing 42 is closer to the hot gas flow path 46. As a result of the relative movement permitted between the inner casing 42 and the outer casing 40 by the hook structures 45, stress caused by these differing amounts of thermal expansion between the inner and outer casings 42, 40 is reduced.

The wall sections 48 described herein may be installed in an engine as part of a repair process, or may be implemented in new engine designs.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine section of a turbine engine comprising:

a rotatable structure, wherein rotation of said rotatable structure during operation of the turbine engine drives at least one of a compressor and a generator;

an outer casing disposed about said rotatable structure; and an inner casing disposed about said rotatable structure and suspended radially inwardly from said outer casing, wherein a dead air space is completely encapsulated between said inner casing and said outer casing, said inner casing defining a hot gas flow path through which hot combustion gases pass during operation of the turbine engine, said inner casing comprising a plurality of wall sections, each wall section comprising:

a panel having an inner portion and an outer portion opposed from and affixed to said inner portion, said inner portion at least partially defining said hot gas flow path, wherein said inner portion is radially spaced from said outer portion such that a substantially fluid tight chamber is formed therebetween radially inwardly from said dead air space, said fluid tight chamber reducing thermal energy transfer from said inner portion to said outer portion and;

an insulating material in said chamber, said insulating material further reducing an amount of thermal energy transferred to said outer portion of said panel from said inner portion.

2. The turbine section of claim 1, wherein said inner casing comprises a plurality of circumferentially extending rows of said wall sections, each row comprising a plurality of said wall sections.

3. The turbine section of claim 1, further comprising a shaft cover assembly disposed about said rotatable structure and located radially inwardly from said inner casing.

4. The turbine section of claim 3, further comprising a plurality of struts extending from said outer casing to said shaft cover assembly, said struts providing structural support for said shaft cover assembly.

5. The turbine section of claim 4, wherein at least some of said panels are shaped to define openings so as to allow said struts to extend from said outer casing to said shaft cover assembly.

6. The turbine section of claim 5, wherein said struts are substantially aligned with one another in a circumferential direction.

7. The turbine section of claim 6, wherein said inner casing is suspended from said outer casing via hook structures, wherein said hook structures are substantially aligned with said struts in the circumferential direction.

8. The turbine section of claim 1, wherein said inner casing is suspended from said outer casing via hook structures, said hook structures permitting relative movement between said inner casing and said outer casing, said hook structures comprising:

first hook shaped members that extend radially inwardly from said outer casing; and second hook shaped members that extend radially outwardly from said panels of said inner casing and engage said first hook shaped members so as to secure said inner casing to said outer casing while permitting relative movement therebetween.

9. The turbine section of claim 1, further comprising a first turbine and a second turbine located axially downstream from said first turbine, wherein said inner casing extends axially between said first turbine and said second turbine.

10. The turbine section of claim 9, wherein said rotatable structure comprises at least one of a first rotatable shaft associated with said first turbine and a second rotatable shaft associated with said second turbine, wherein rotation of said first rotatable shaft drives a compressor and rotation of said second rotatable shaft drives an electric generator.

11. A wall section of an inner casing through which hot combustion gases pass in a turbine engine, the inner casing being suspended radially inwardly from an outer casing, the wall section comprising:

a panel having an inner portion and an outer portion affixed to said inner portion, said inner and outer portions being radially spaced from and opposed from one another such that a substantially fluid tight chamber is defined therebetween, said inner portion at least partially defining a hot gas path through which the hot combustion gases pass and said outer portion radially spaced from said hot gas path, wherein said panel includes at least one cut-out portion to allow at least one strut to extend from the outer casing to a shaft cover assembly located radially inwardly from the inner casing; and an insulating material in said chamber, said insulating material limiting an amount of heat transferred to said outer portion of said panel from said inner portion.

12. The wall section of claim 11, wherein said insulating material is completely encapsulated in said chamber.

13. The wall section of claim 11, wherein said insulating material comprises a porous insulating material.

14. The wall section of claim 11, wherein said insulating material comprises one of a woven cloth and a ceramic insert having a shape that generally corresponds to said chamber.

15. The wall section of claim 11, wherein said outer portion has a thickness that is less than a thickness of said inner portion.

16. The wall section of claim 11, further comprising hook shaped members that extend radially outwardly from opposing sides of said panel, said hook shaped members adapted to engage corresponding hook shaped members that extend radially inwardly from the outer casing for supporting said panel radially inwardly from the outer casing.

17. A turbine section of a turbine engine comprising:

a rotatable structure, wherein rotation of said rotatable structure during operation of the turbine engine drives at least one of a compressor and a generator;

an outer casing disposed about said rotatable structure; and an inner casing disposed about said rotatable structure and suspended radially inwardly from said outer casing, said inner casing defining a hot gas flow path through which hot combustion gases pass during operation of the turbine engine, said inner casing comprising a plurality of wall sections, each wall section comprising:

a panel having an inner portion and an outer portion opposed from and affixed to said inner portion, said inner portion at least partially defining said hot gas flow path, wherein said inner portion is radially spaced from said outer portion such that a substantially fluid tight chamber is formed therebetween, said fluid tight chamber reducing thermal energy transfer from said inner portion to said outer portion;

wherein at least some of said panels are shaped to define openings so as to allow struts to extend from said outer casing to a shaft cover assembly disposed about said rotatable structure and located radially inwardly from said inner casing.

18. The turbine section of claim 17, wherein said struts are substantially aligned with one another in a circumferential direction.

19. The turbine section of claim 18, wherein said inner casing is suspended from said outer casing via hook structures, wherein said hook structures are substantially aligned with said struts in the circumferential direction.

20. The turbine section of claim 17, further comprising an insulating material in said chamber, said insulating material further reducing an amount of thermal energy transferred to said outer portion of said panel from said inner portion.

* * * * *